US011035094B1

(12) United States Patent
Ferguson

(10) Patent No.: US 11,035,094 B1
(45) Date of Patent: Jun. 15, 2021

(54) DEVICE AND METHOD FOR EXTENDING MATERIAL MOVER REACH

(71) Applicant: Ferguson Trailer Transport, Inc., Dover, MN (US)

(72) Inventor: Craig Ferguson, Dover, MN (US)

(73) Assignee: Ferguson Trailer Transport, Inc., Dover, MN (US)

( * ) Notice: Subject to any disclaimer, the term of this patent is extended or adjusted under 35 U.S.C. 154(b) by 0 days.

(21) Appl. No.: 17/127,606

(22) Filed: Dec. 18, 2020

Related U.S. Application Data

(60) Provisional application No. 62/959,876, filed on Jan. 10, 2020.

(51) Int. Cl.
*E02F 3/36* (2006.01)
*E02F 3/34* (2006.01)
*E02F 3/96* (2006.01)

(52) U.S. Cl.
CPC ..... *E02F 3/3677* (2013.01); *E02F 3/3405* (2013.01); *E02F 3/96* (2013.01)

(58) Field of Classification Search
USPC ..... 403/356
See application file for complete search history.

(56) References Cited

U.S. PATENT DOCUMENTS

| | | | |
|---|---|---|---|
| 4,984,957 | A | 1/1991 | Noguchi |
| 6,116,847 | A | 9/2000 | Ginn et al. |
| 6,499,904 | B2 | 7/2002 | Nye |
| 7,568,878 | B2 | 8/2009 | Frey |
| 8,007,197 | B2 | 8/2011 | Nye |
| 8,459,927 | B2 | 6/2013 | England |
| 8,469,623 | B2 | 6/2013 | Luyendijk |
| 9,376,783 | B2 | 6/2016 | Ulrich et al. |
| 9,534,352 | B2 | 1/2017 | Kusama |

(Continued)

FOREIGN PATENT DOCUMENTS

| | | | |
|---|---|---|---|
| CN | 203066130 | U | 7/2013 |
| EP | 0321902 | B1 | 3/1994 |

(Continued)

OTHER PUBLICATIONS

NYE, https://nyemanufacturing.com/products/loader-arm-extensions/, last visited Dec. 18, 2020.

(Continued)

*Primary Examiner* — Ronald P Jarrett
(74) *Attorney, Agent, or Firm* — Headland Law & Strategy

(57) ABSTRACT

An extender for a material mover may include an extension plate, an inner cap plate, an outer cap plate, securing fasteners and a securing pin. The extension plate may have an arcuate recess configured to be disposed around a lifter arm on the material mover. The extension plate may include an extended-lifter segment with an implement-retention aperture, a first aperture, and second aperture. The inner cap plate and outer cap plate may each include a top aperture, a bottom aperture, and a retention aperture. The securing fasteners may be configured to secure the inner cap plate, outer cap plate and extension plate together (i) through the top apertures and first aperture, and (ii) through the bottom apertures and second aperture. The securing pin may be configured to secure the inner cap plate, outer cap plate, and lifter arm together through the retention apertures and a lifter-arm retention aperture.

20 Claims, 9 Drawing Sheets

(56) References Cited

U.S. PATENT DOCUMENTS

| | | | |
|---|---|---|---|
| 9,662,746 | B2 | 5/2017 | Ulrich et al. |
| 2019/0135599 | A1 | 5/2019 | Myers et al. |

FOREIGN PATENT DOCUMENTS

| | | | |
|---|---|---|---|
| EP | 3553231 | A1 | 10/2019 |
| GB | 2224483 | B | 4/1992 |
| KR | 1976948 | B1 | 5/2019 |
| WO | WO90006403 | A1 | 6/1990 |
| WO | WO2005035881 | A1 | 4/2005 |

OTHER PUBLICATIONS

Ryland Manufacturing, http://www.rylind.com/wheel-loaders/loader-arm-extensions.html, last visited Dec. 18, 2020.
Huina Wheel Loader with Arm Extension 3d Printed, https://www.youtube.com/watch?v=Y41ph7QLn20, last visited Dec. 18, 2020.

DEVICE AND METHOD FOR EXTENDING MATERIAL MOVER REACH

CROSS-REFERENCE TO RELATED APPLICATION

This application claims the benefit of U.S. Patent Application Ser. No. 62/959,876, titled "High-Lift Kit for Loaders," filed on Jan. 10, 2020, and incorporates the entire contents thereof herein by reference.

TECHNICAL FIELD

Various implementations relate generally to loaders, such as front-end and wheel loaders having buckets or other work implements that can be extended to a height and tilted forward to release their payload.

BACKGROUND

Loaders are widely used in construction, industrial, farming and other utility applications. In many applications, they are employed to transport a load from one location to another, or to lift a load to a height and release it. For example, in some applications, a farmer may use a loader to lift grain to a height and release it. More particularly, the height may correspond to the side of a hopper-bottom grain trailer, and the loader may be used to lift the grain up and into the trailer from the side.

SUMMARY

For many construction, industrial, farming and other utility operations, loaders and other equipment represent significant capital investments. Once purchased, operators may be reluctant to replace them. However, the needs of given operations may change over time. For example, a farming operation may be constantly adapting its processes to increase efficiencies. A grain harvesting operation may expand over time, and taller grain trailers may become advantageous.

In some instances, changes in such processes may necessitate changes in how payloads of various kinds (e.g., grain) are handled, including how high they must be lifted. Different loaders have different reaches, or operating heights. However, given the significant capital investment that a loader represents, it may be advantageous for some operators to modify an existing loader to extend its reach and operating height, rather than replacing it with one that is designed with a longer reach.

Described herein are an apparatus, kit and method for extending the reach of a loader. More specifically, an adapter kit and method are described that can be employed to couple a payload bucket or other implement to a corresponding lifting mechanism (e.g., lifting arm(s), "Z-bar" and "dog bone," as described herein) to extend the overall reach or height. In some implementations, such a kit can extend the utility of an existing loader or material mover—obviating the need, in some implementations, for an operator to make a significant investment to replace an existing piece of equipment.

In some implementations, an extender for a material mover includes an extension plate, an inner cap plate, an outer cap plate, securing fasteners and a securing pin. In some implementations, the material mover is a front-end loader.

The extension plate may have an arcuate recess configured to be disposed around a top edge, a front edge, and a bottom edge of a lifter arm on the material mover. The extension plate may include an extended-lifter segment with an implement-retention aperture disposed at its end, opposite the arcuate recess. The extension plate may include a first aperture and second aperture that, when the extension plate is disposed around the lifter arm, are adjacent the top edge and bottom edge respectively.

The inner cap plate and outer cap plate may each include a top aperture, a bottom aperture, and a retention aperture. When the inner cap plate and outer cap plate are disposed on either side of the lifter arm and extension plate, the top apertures may be aligned with the first aperture, the bottom apertures may be aligned with the second aperture, and the retention aperture may be aligned with a lifter-arm retention aperture.

The securing fasteners may be configured to secure the inner cap plate, outer cap plate and extension plate together (i) through the top apertures and first aperture, and (ii) through the bottom apertures and second aperture. The securing pin may be configured to secure the inner cap plate, outer cap plate and lifter arm together through the retention apertures and lifter-arm retention aperture. In some implementations, the securing pin is a large-bore threaded bolt and nut. In some implementations, the securing pin is a clevis pin. The securing fasteners may be threaded bolts and nuts.

In some implementations, the extender may further include one or more spacers, each of which may include a top-spacer aperture, a bottom-spacer aperture, and an arcuate-spacer recess. When the one or more spacers are disposed adjacent the lifter arm and extension plate and between the outer cap plate and inner plate, the top-spacer aperture may be aligned with the top apertures and first aperture, and the bottom-spacer aperture may be aligned with the bottom-spacer aperture and second aperture. The arcuate-spacer recess may be configured to fit snugly around the lifter arm of a specific make and model of a material mover.

In some implementations, a kit for extending a vertical reach of a material mover includes first and second extenders for corresponding first and second lifter arms of the material mover, securing pins, and an extended linkage. Each of the first and second extenders may include an extension plate, an inner cap plate, and outer cap plate.

The extension plate may include (i) an arcuate recess configured to be disposed around a top edge, a front edge and a bottom edge of a corresponding lifter arm, and (ii) an extended-lifter segment with an implement-retention aperture disposed at its end, opposite the arcuate recess. The extension plate may include a first aperture and second aperture that, when the extension plate is disposed around the corresponding lifter arm, are adjacent the top edge and bottom edge respectively.

The inner cap plate and outer cap plate may each include a top aperture, a bottom aperture, and a retention aperture. When the inner cap plate and outer cap plate are disposed on either side of the corresponding lifter arm and extension plate, the top apertures may be aligned with the first aperture, the bottom apertures are aligned with the second aperture, and the retention aperture may be aligned with a lifter-arm retention aperture.

Securing pins may be configured to secure corresponding lifter arms, inner cap plates, and outer cap plates through the retention apertures and lifter-arm retention apertures.

The extended linkage may be configured to couple, on one end, an implement that is removably attached to the first and second extenders through the implement-retention apertures, and on the other end, an actuated rocker arm of the material mover.

The kit may further include an alignment rod configured to be temporarily disposed in the implement-retention apertures of the first and second extenders, as the first and second extenders are secured to the corresponding lifter arms.

In some implementations, a method of extending a reach of a material mover includes uncoupling and removing a first linkage that couples a work implement to an actuated rocker arm on the material mover; uncoupling the work implement from a first lifter arm and from a second lifter arm; securing a first extension to the first lifter arm and a second extension to the second lifter arm; coupling the implement to the first extension and second extension; and coupling a second linkage to the work implement and the actuated rocker arm, wherein the second linkage is longer than the first linkage.

Securing each of the first extension and second extension may include (a) fastening, with a first fastener, a relevant extension to a corresponding lifter arm, though a lifter-arm retention aperture, and (b) further securing the relevant extension to the corresponding lifter arm with a second fastener adjacent a top edge of an end of the corresponding lifter arm, and with a third faster adjacent a bottom edge of the end of the corresponding lifter arm.

In some implementations, the implement is a bucket. In some implementations, the implement is a set of lifting forks.

Uncoupling the implement may include removing a first coupling pin that couples one side of the implement to the first lifter arm and removing a second coupling pin that couples another side of the implement to the second lifter arm.

The first extension and second extension may each include an outer cap plate, an inner cap plate, and an extension plate. The outer cap plate and inner cap plate may each include a retention aperture configured to align with a corresponding lifter-arm retention aperture.

The first extension and second extension may each further include one or more spacer plates that are configured to fit snugly around an end of the corresponding lifter arm for a specific make and mode of material mover. The first extension and second extension may each have an arcuate recess configured to fit around an end of a corresponding lifter arm.

The extension plate may have a first aperture and second aperture, and each of the outer cap plate and inner cap plate may have top apertures and bottom apertures. The first aperture may be configured to be aligned with the top apertures, and the second aperture may be configured to be aligned with the bottom apertures.

Further securing the relevant extension may include securing the outer cap plate, inner cap plate, and extension plate with a first securing fastener disposed through the first aperture and top apertures, and with a second securing fastener disposed through the second aperture and bottom apertures.

The method may further include aligning the first extension and second extension by disposing an alignment rod in an extension-aperture of the first extension and an extension-aperture of the second extension prior to securing the relevant extension to the corresponding lifter arm.

DETAILED DESCRIPTION OF EXEMPLARY IMPLEMENTATIONS

Figure 1A:
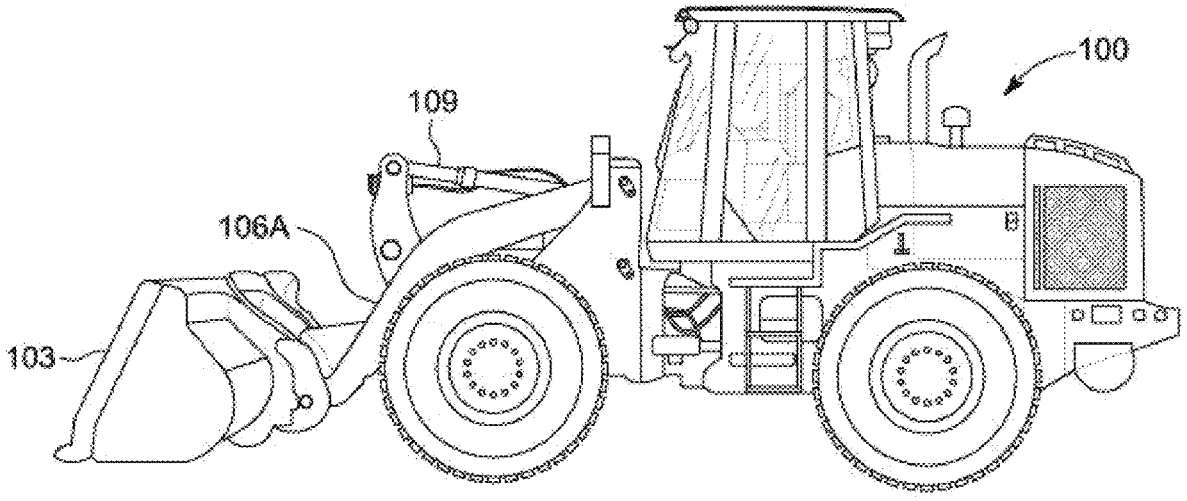
FIG. 1A is a side view of an exemplary wheel loader.
Figure 1B:
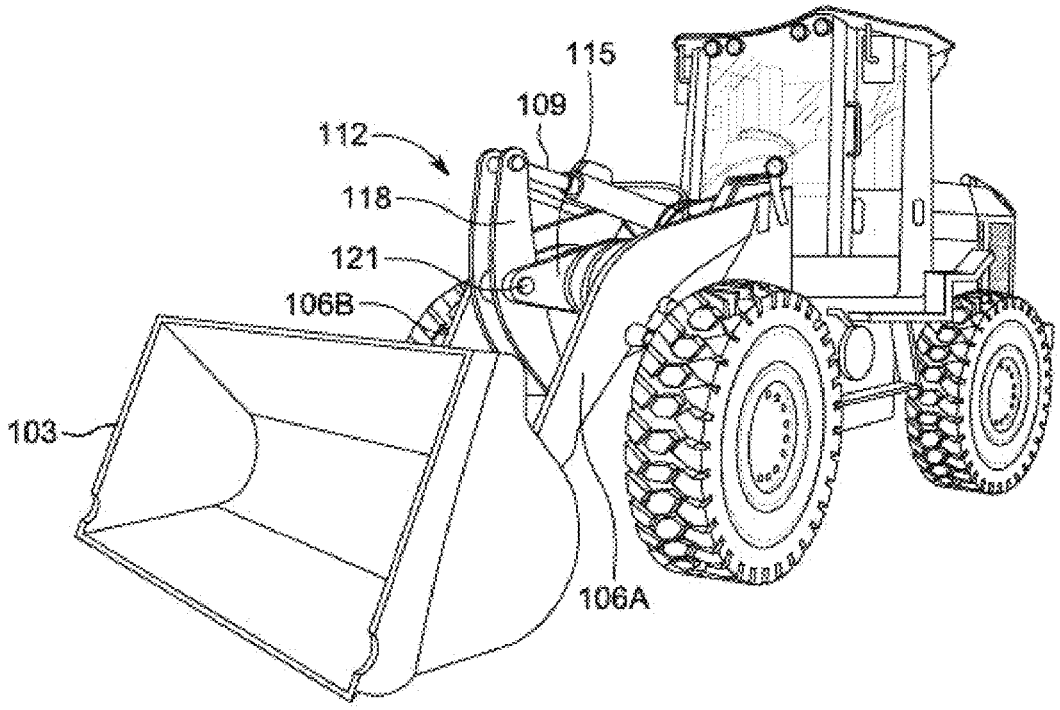
FIG. 1B is a perspective view of the exemplary wheel loader of FIG. 1A.

FIG. 1A depicts an exemplary wheel loader 100, as viewed from the side; FIG. 1B provides a perspective view of the same wheel loader 100. As shown, the wheel loader 100 includes a bucket 103 for collecting, transporting and lifting a payload (e.g., snow, dirt, grain, rocks, etc.). The bucket 103 is supported by a pair of lifter arms 106A, 106B. The lifter arms 106A and 106B and bucket 103 may be lifted into the air by one or more hydraulic cylinders (not shown), and the bucket 103 may be articulated forward or backward, for example to retain or release a load.

To articulate the bucket 103 forward or backward, the exemplary loader 100 includes a mechanical linkage 112 and another hydraulic cylinder 109 that actuates the linkage 112. In the implementation depicted, the mechanical linkage 112 includes a lever 115 that is mounted between the lifter arms 106A and 106B, a linkage element 118 (sometimes referred to as a "Z bar") that pivots about an axis 121, and another linkage element that is sometimes referred to as a "dog bone" (not shown in FIG. 1A or FIG. 1B).

In some implementations, it can be advantageous to extend the reach of the loader (e.g., the operating height or vertical extent to which the bucket or other work implement can reach). Described herein are an apparatus, method and kit for extending the reach of a material mover. In some implementations, the apparatus includes an extension plate for each lifter arm, and an extended linkage. An exemplary extension plate is now described.

Figure 2A:
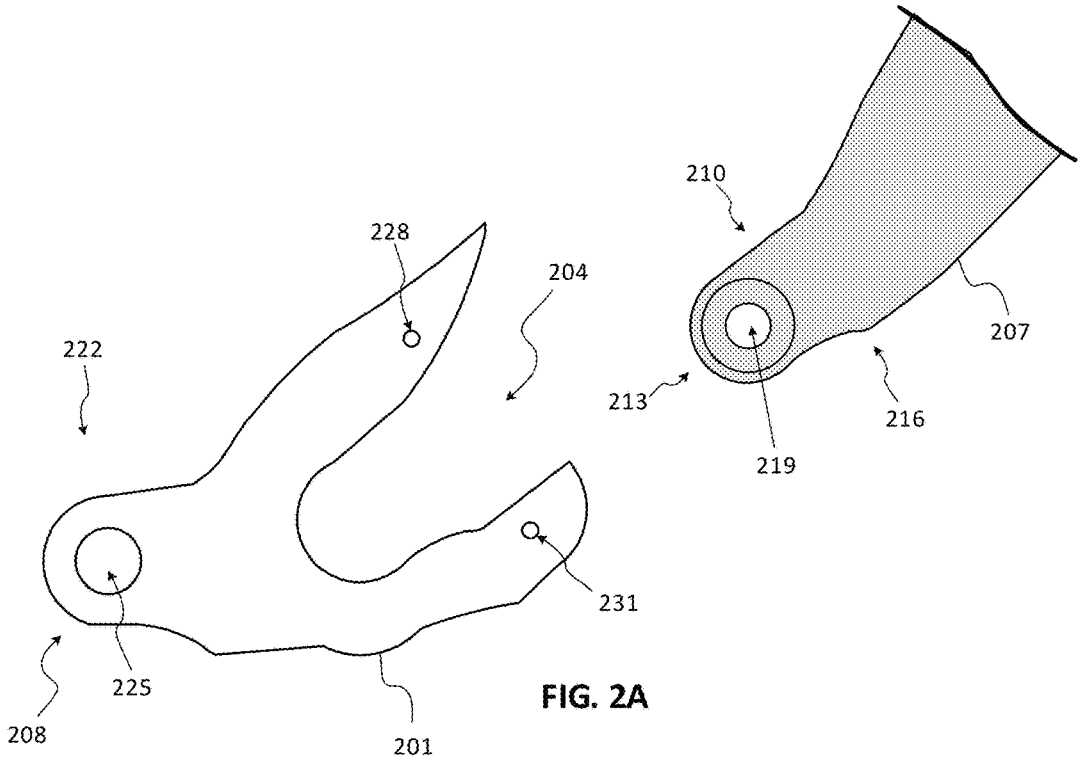
FIG. 2A illustrates an exemplary extension plate.

FIG. 2A illustrates an exemplary extension plate 201. As shown, the extension plate 201 includes an arcuate recess 204, which may be configured to fit around the end of a lifter arm 207. Specifically, the arcuate recess 204 can be configured to extend around a top edge 210, front edge 213, and bottom edge 216 of the lifter arm 207.

At an end 208 of the extension plate 201, opposite the arcuate recess 204, is an extended lifter segment 222. The extended lifter segment 222 includes an implement-retention aperture 225 that, in some implementations, serves the same function as the lifter-arm retention aperture 219 (e.g., facilitates retention of a work implement, such as a bucket).

As shown, the extension plate 201 includes a first aperture 238 and a second aperture 231. In some implementations, these apertures 228 and 231 are configured to, in combination with other elements, secure the extension plate 201 to the lifter arm 207. Two such additional elements are now described.

Figure 2B:
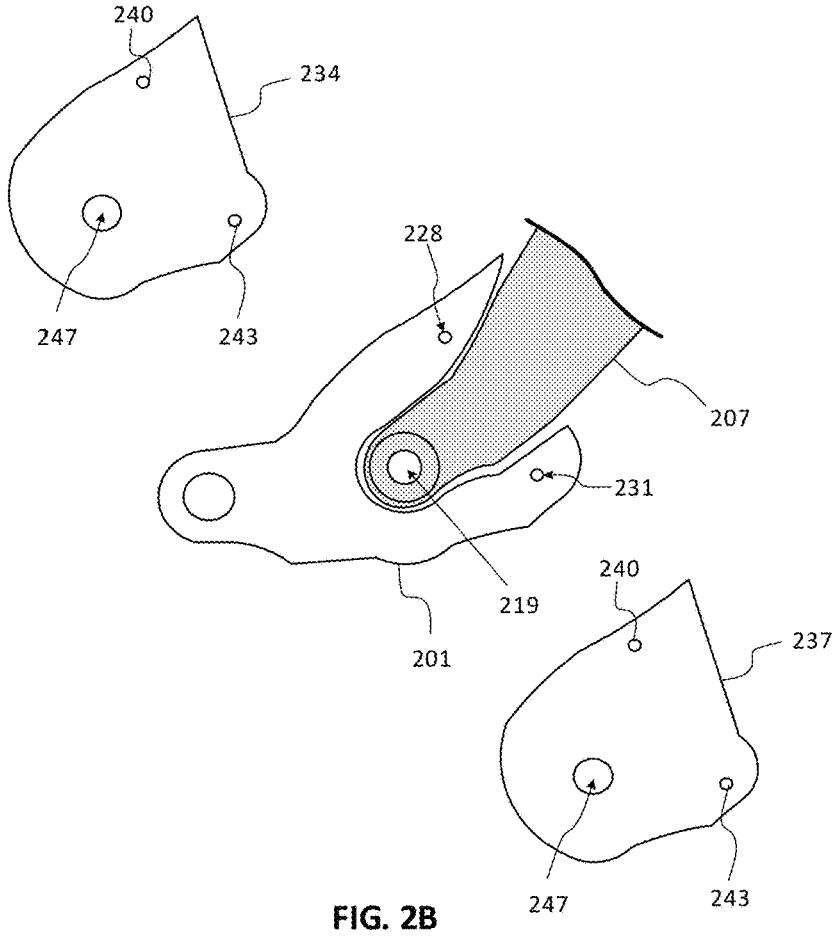
FIG. 2B illustrates exemplary cap plates that may be used in conjunction with an extension plate.

FIG. 2B illustrates additional elements that complement the extension plate 201, in some implementations. In particular, an inner cap plate 234 and outer cap plate 237 may be provided. The inner cap plate 234 and outer cap plate 237 can be configured to be disposed adjacent and on either side of the extension plate 201 and the lifter arm 207—to secure the lifter arm 207 to the extension plate 201. The inner cap plate 234 and outer cap plate 237 each include top apertures 240 and bottom apertures 243.

As is illustrated in subsequent figures, in some implementations, the top apertures 240 of the inner cap plate 234 and outer cap plate 237 align with the first aperture 228 of the extension plate 201; and the bottom apertures 243 of the inner cap plate 234 and outer cap plate 237 align with the second aperture 231 of the extension plate. As shown, the inner cap plate 234 and outer cap plate 237 also include retention apertures 247, which, in some implementations, are configured to align with the lifter-arm retention aperture 219.

Figure 2C:
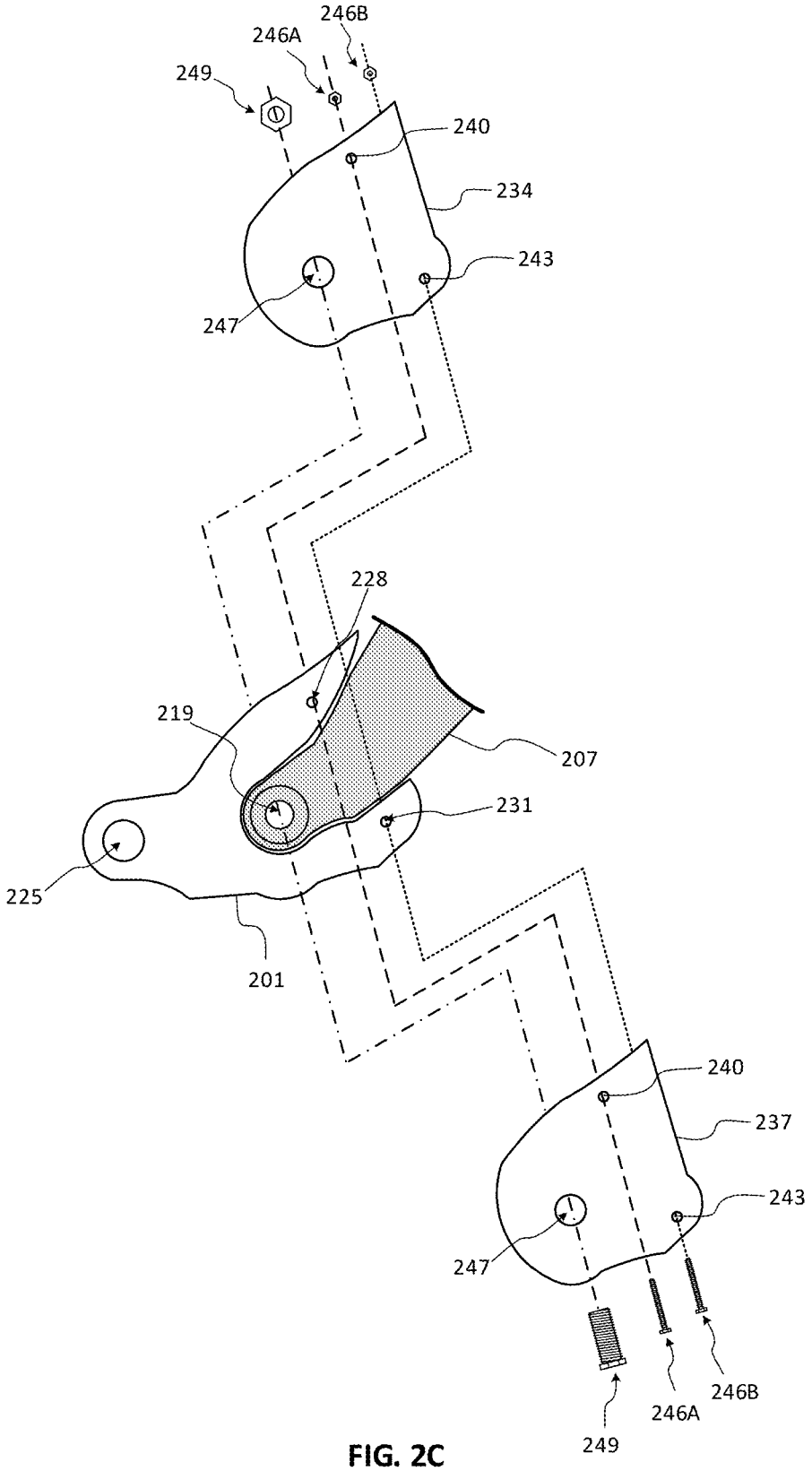
FIG. 2C illustrates the coupling of an inner cap plate, an extension plate and an outer cap plate, in one implementation.

Turning to FIG. 2C, one way is illustrated in which the inner cap plate 234, extension plate 201, lifter arm 207, and outer cap plate 237 can be coupled. In particular, securing fasteners 246A and 246B can be employed to secure the aforementioned elements together. That is, a securing faster 246A can be disposed through the top aperture 240 of the outer cap plate 237, through the first aperture 228 of extension plate 201, and through the top aperture 240 of the inner cap plate 234. Similarly, the securing faster 246B can be disposed through the bottom aperture 243 of the outer cap plate 237, through the second aperture 231 of extension plate 201, and through the bottom aperture 243 of the inner cap plate 234. In some implementations, as shown, the securing fasteners 246A and 246B are threaded bolts and nuts; in other implementations, a clevis pin, grooved pin and corresponding cotter pin or retention ring, or other similar removable securing mechanism may be employed.

A larger securing pin 249 may also be employed to further secure the outer cap plate 237, extension plate 201, lifter arm 207, and inner cap plate 234 together. As shown, in some implementations, the securing pin 249 can be disposed through the retention aperture 247 of the outer cap plate 237, through the lifter-arm retention aperture 219 of the lifter arm 207, and through the retention aperture 247 of the inner cap plate 234. In some implementations, as shown, the securing pin 249 can be a large-bore threaded bolt and nut; in other implementations, a large clevis pin, grooved pin and corresponding cotter pin or retention ring, or other similar removable securing mechanism may be employed.

With the securing pin 249 and securing fasteners 246A and 246B disposed as described above, the lifter arm 207 can be securely fastened to the extension plate by the inner cap plate 234 and outer cap plate 237. With the extension plate 201 so secured, the lifter-arm retention aperture 219 can be effectively repositioned and replaced with the implement-retention aperture 225 of the extension plate 201. Because the implement-retention aperture 225 is, in this configuration, positioned farther down and away from the original end of the lifter arm 207, a reach of the lifter arm 207 can be effectively extended, as will be described further with reference to subsequent figures.

Figure 2D:
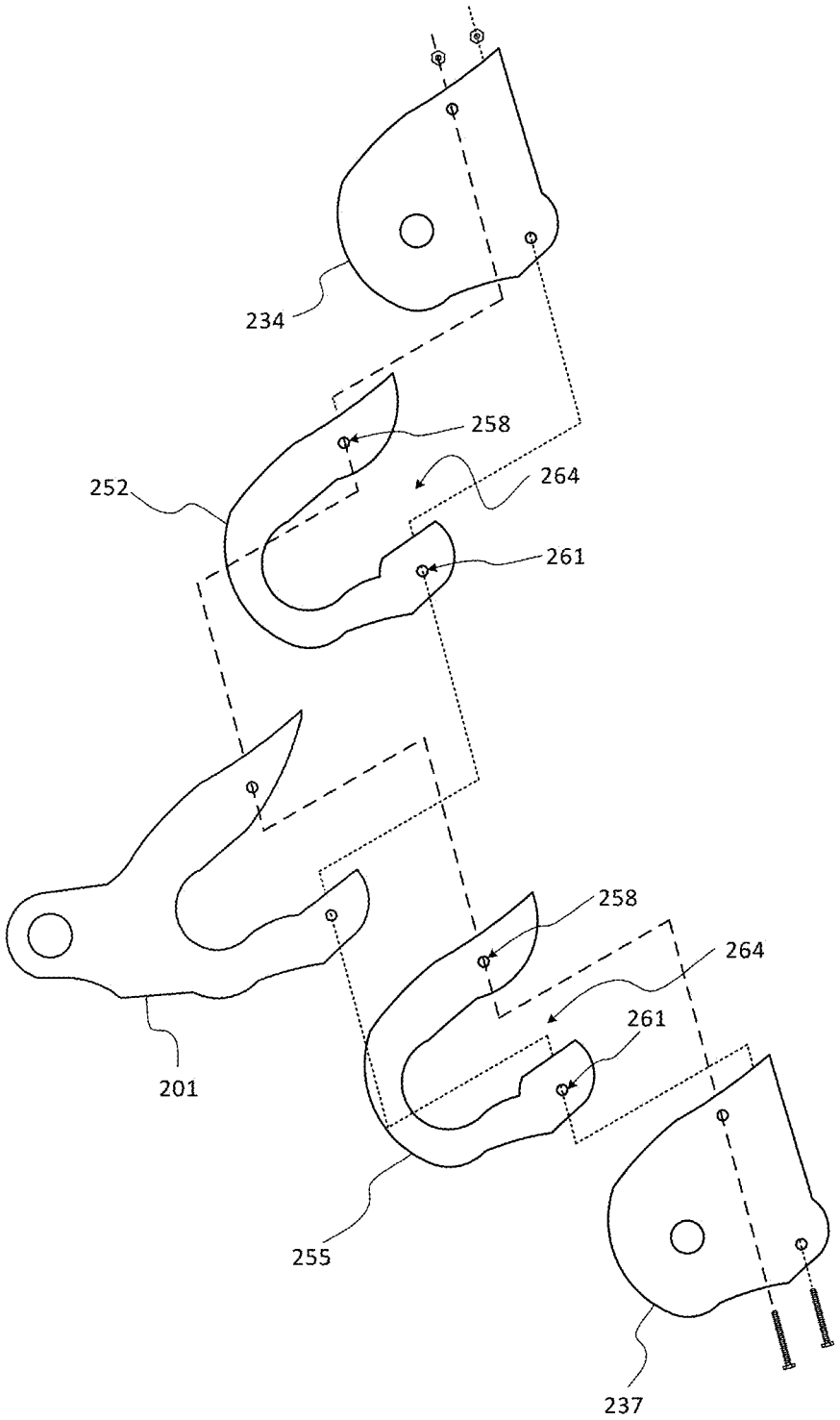
FIG. 2D illustrates optional spacer plates that may be employed in some implementations.

FIG. 2D illustrates additional components that can be employed to secure a lifter arm to an extension plate 201. In particular, some implementations include one or more spacers, such as spacer 252 and spacer 255. Each of the spacers 252 and 255 can include top-spacer apertures 258 and bottom-spacer apertures 261, which can be configured to align with the above-described apertures, in the manner illustrated. In some implementations, one or more spacers 252 and 255 can be employed to achieve a more secure coupling between the extension plate 201, inner cap plate 234, outer cap plate 237 and the lifter arm (not shown in FIG. 2D). In particular, in some implementations, a spacer-arcuate recess 264 can be configured to snugly accommodate (e.g., accommodate with a small tolerance) the precise shape and dimensions of a lifter arm corresponding to a specific make and model of material mover.

By including spacers 252 and 255, some implementations enable coupling between a standard extension plate 201, a standard inner cap plate 234, and a standard outer plate 237; and lifter arms from various material movers (e.g., wheel loaders, skid steers, loaders, utility tractors, farm tractors, etc.), from various manufacturers. In this manner, a wide array of extension capabilities can be provided with a relatively limited number of unique components. In some implementations, the spacers 252 and 255 and extension plate 201 may be customized for a specific make and model of material mover.

In addition, in some implementations, a kit that includes a variety of spacer elements 252 and 255 with slightly varying dimensions can be provided in order to provide a snug fit while still accommodating different tolerances across multiple instances of the same make and model of a material mover. This can be advantageous to accommodate material movers that have been repaired or altered in a way that changes the original factory specifications of the lifter arm.

Figure 2E:
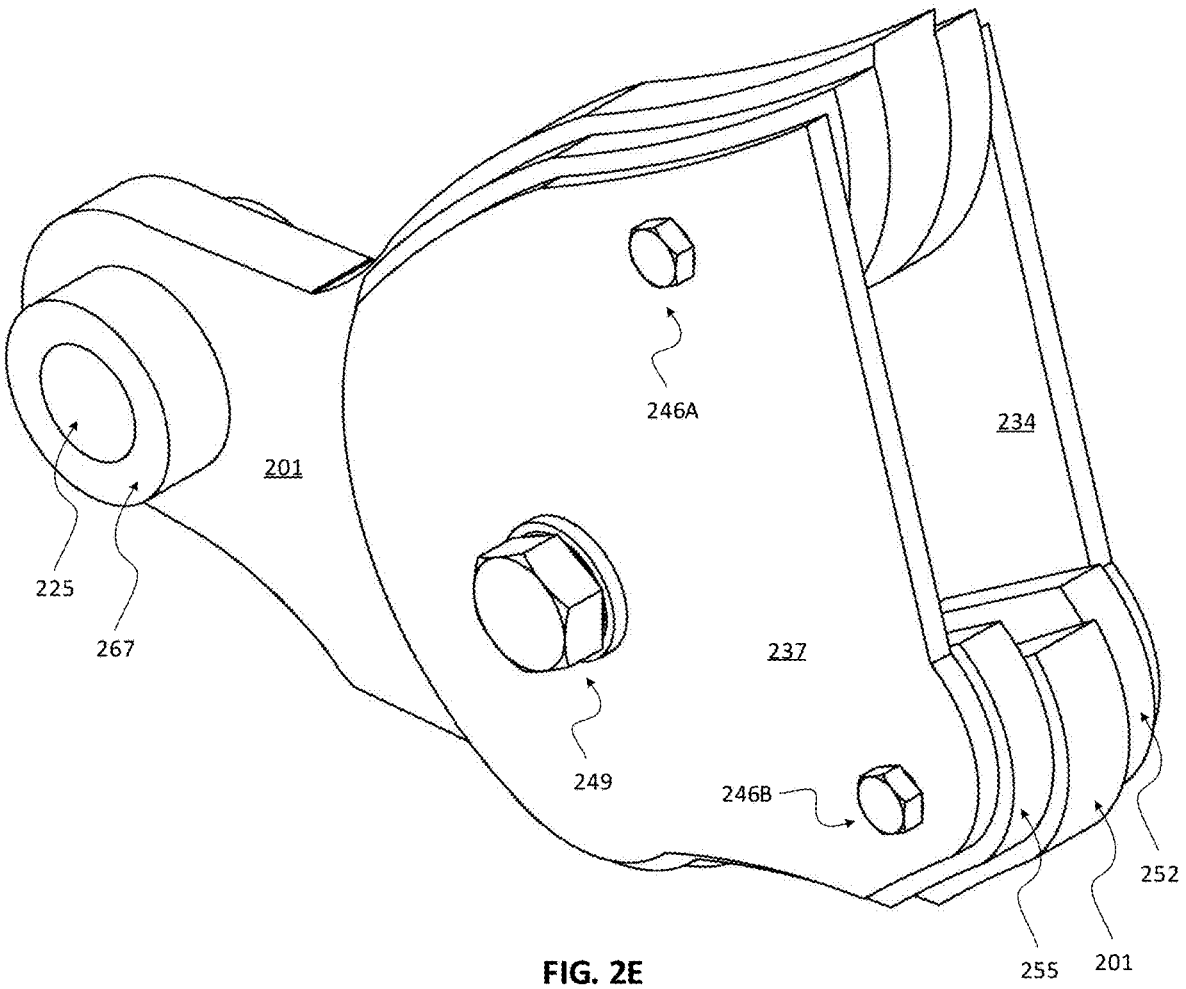
FIG. 2E illustrates an exemplary extension assembly.

FIG. 2E illustrates one implementation in which an assembly has been secured together. As shown, the assembly includes outer cap plate 237, spacer 255, extension plate 201, spacer 252, and inner cap plate 234. As shown in one implementation, the implement-retention aperture 225 can be reinforced with a reinforcement ring 267. In such an implementation, the reinforcement ring 267 may provide additional structural support at the point at which the extension plate 201 is coupled to a work implement.

Figure 3A:
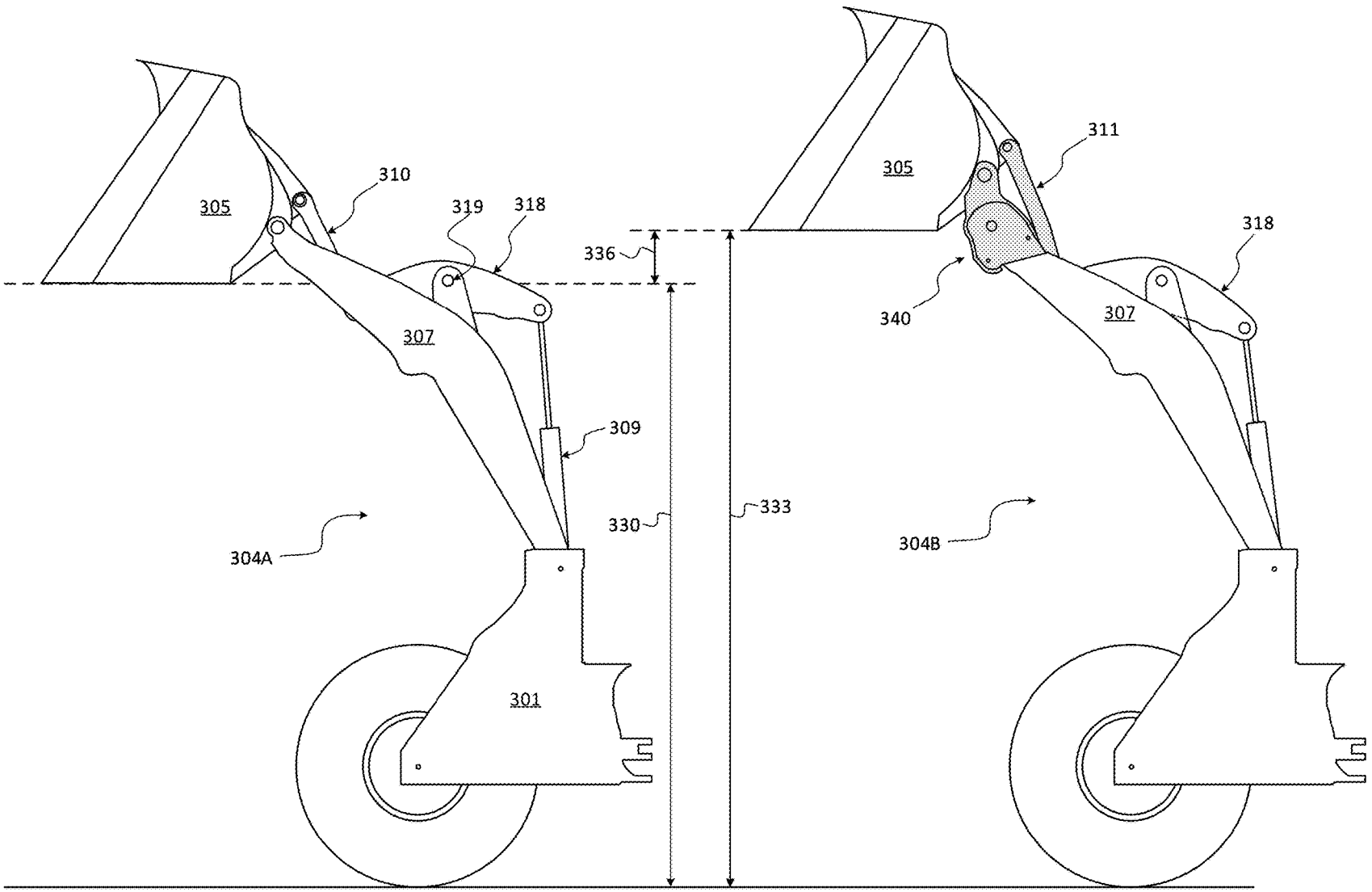
FIGS. 3A and 3B depict how an incremental increase in operating height can be achieved by modifying certain elements of a material mover.

Turning now to FIG. 3A, a manner in which the components described above can extend the reach of a material mover are now illustrated and described in more detail. In configuration 304A, a material mover 301 is shown in an "unmodified" manner (e.g., according to factory specifications). In this configuration, a bucket 305 is coupled directly to lifter arm 307 (and a second lifter arm which is not visible in FIG. 3A); and a second connection is made between the bucket 305 and an actuated rocker 318, by a linkage 310.

As partially illustrated, the linkage 310 is coupled to one end of a rocker arm 318 that pivots about an axis 319, and the opposite end of the rocker arm 318 is coupled to an actuator 309. In some implementations, as shown, the actuator 309 is a hydraulic cylinder. When extended, the actuator 309 pivots the rocker arm 318 away from the bucket 305, causing the linkage 310 to tip the bucket 305 upward about an axis formed by the coupling between the lifter arm 307 and the bucket 305; when withdrawn, the actuator 309 causes the rocker arm 318 to pivot towards the bucket, causing the linkage 310 to tip the bucket 305 forward. As shown, the bucket 305 has an operating height 330 in configuration 304A.

In a modified configuration 304B, an operating height 333 can be achieved that is higher than the operating height of the unmodified configuration 304A. As shown, this higher operating height 333 provides an incremental increase 336 in operating height or reach.

In some implementations, this incremental increase 336 can enable a material mover operator to employ the material mover in applications that would not otherwise be possible. For example, in a grain loading application, the incremental increase 336 may facilitate loading of higher grain trailers that would otherwise not be possible. Moreover, the specific design of the implementations described herein may result in an extension of reach or operating height, without a significant reduction in load carrying capacity of the material mover, or without significant change to the center of gravity of the material mover (and, by extension, the safety of its operation, in some implementations).

To facilitate the incremental increase 336 in operating height in configuration 304B, an extension assembly 340 may be employed. In some implementations, the extension assembly 340 includes an extension plate, an inner cap plate, an outer cap plate, and, optionally, one or more spacers—as described with reference to the preceding figures. In addition to the extension assembly 340 in configuration 304B, one other modification may be required. In particular, the linkage 310 of configuration 304A may be replaced with a longer linkage 311.

Figure 3B:
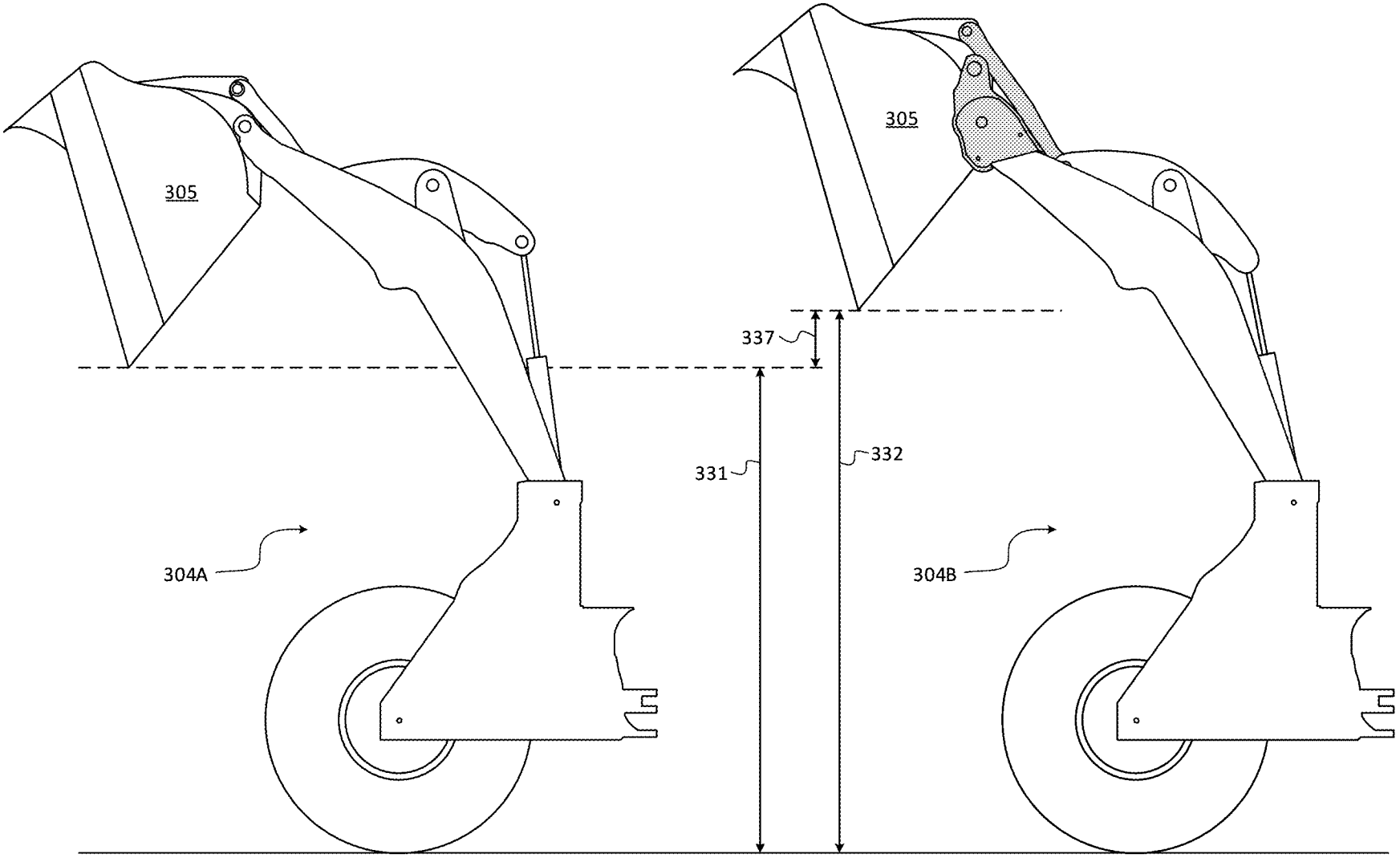

FIG. 3A illustrates the incremental increase 336 in operating height that configuration 304B may provide, relative to configuration 304A. As shown in FIG. 3A, the bucket 305 is horizontal. In FIG. 3B, a similar incremental increase 337 in illustrated when the bucket 305 is tipped forward, as it would be during an unloading operation. As shown, the operating height 332 is higher in the "modified" configuration 304B, relative to the operating height 331 of the "unmodified" configuration 304A.

Figure 4:
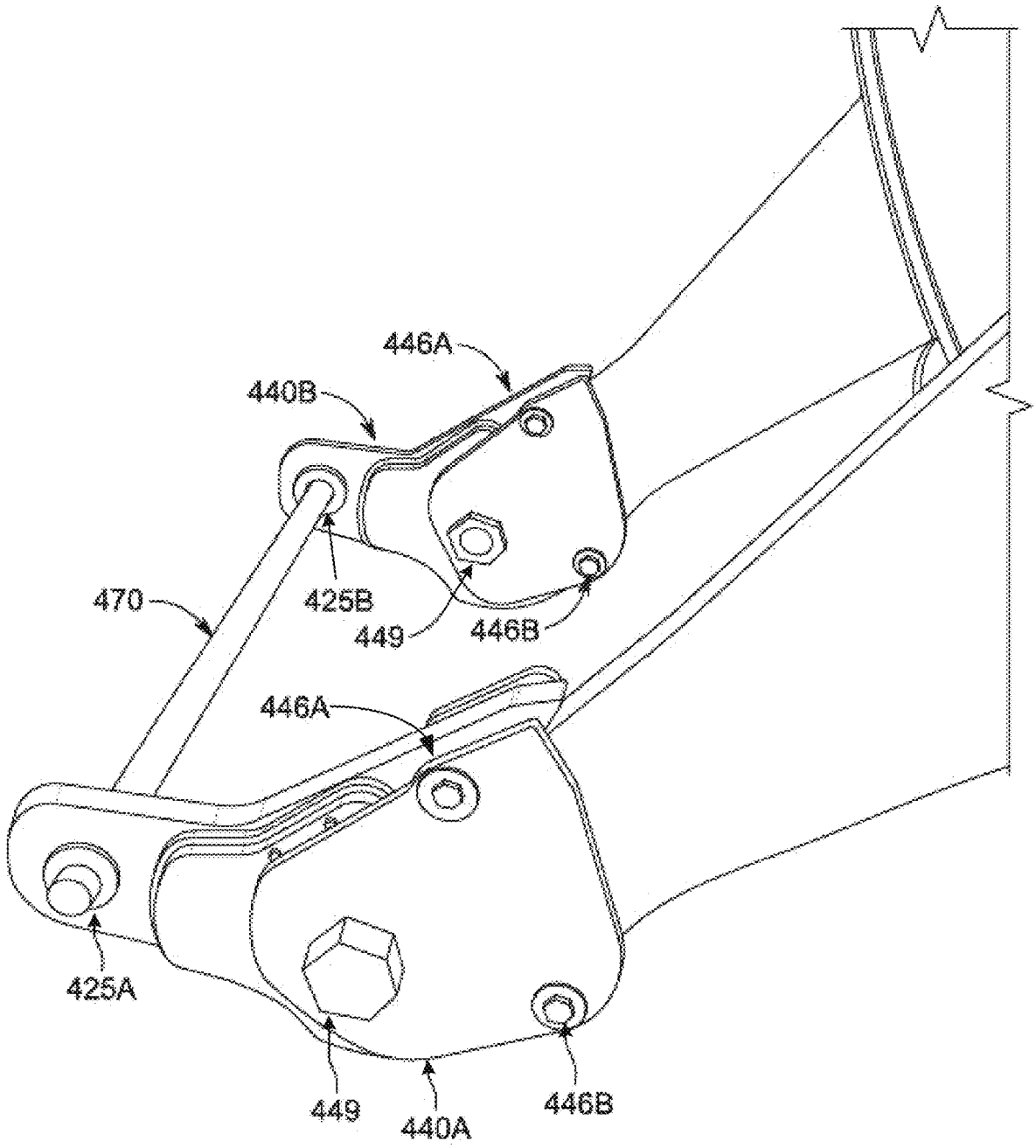
FIG. 4 illustrates an exemplary alignment rod.

FIG. 4 illustrates an additional component that may be provided in a "high-lift kit" for extending the reach or operating height of a material mover. In particular, an alignment rod 470 can be provided to facilitate alignment of extension assemblies 440A and 440B relative to corresponding lifter arms 407A and 407B. Such an alignment rod 407 may be temporarily disposed in the implement-retention aperture 425A of a first extension assembly 440A and in the implement-retention aperture 425B of the second extension assembly 440B. After the alignment rod 470 is so disposed, the extension assemblies 440A and 440B may be secured to the corresponding lifter arms 407A and 407B (e.g., by installation and tightening of securing fasteners 446A and 446B and securing pins 449). In this manner, implement-retention apertures 425A and 425B may be more precisely aligned than they otherwise may be—thereby simplifying installation of a work implement (e.g., a bucket or set of lifting forks), in some implementations.

In some implementations, the alignment rod 470 may be particularly advantageous where a lifter arm has been damaged (e.g., bent or warped). In such implementations, the extension assemblies 440A and 440B may be loosely positioned, and the alignment rod 470 may be disposed prior to the securing fasteners 446A and 425B and/or securing pins 449 being tightened on the lifter arms 407A and 407B. Depending on the severity of the damage, the extension plate or spacers (if present) may require minor modification (e.g., grinding or reshaping), and the alignment rod 470 may facilitate identification of any such required modification.

Figure 5:
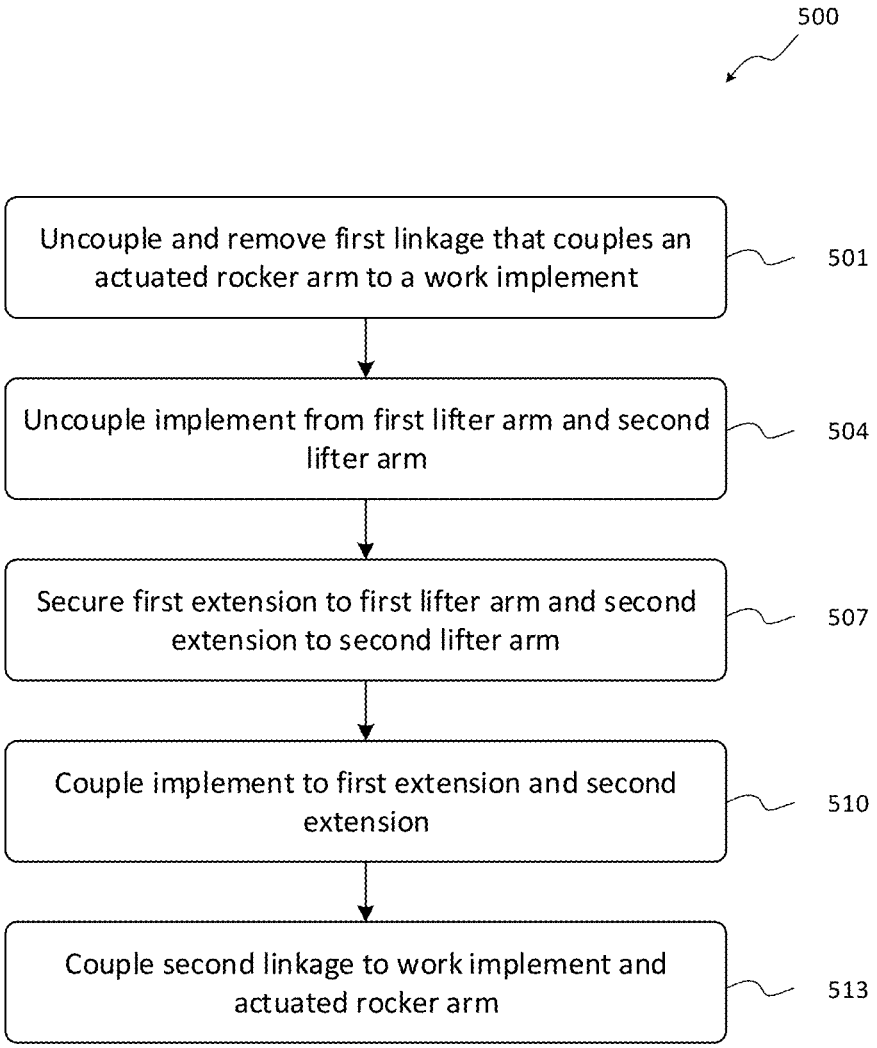
FIG. 5 is a flow diagram of an exemplary method for modifying a material mover.

FIG. 5 illustrates an exemplary method 500 for extending the reach or operating height of a material mover.

As shown, the method 500 includes uncoupling and removing (501) a first linkage the couples an actuated rocker arm to a work implement. For example, with reference to FIG. 3A, the linkage 310 may be uncoupled from the bucket 305 and from the actuated rocker arm 318.

The method 500 further includes uncoupling (504) the implement from the first lifter arm and the second lifter arm. For example, with reference to FIG. 1B, the bucket 103 may be uncoupled from the lifter arms 106A and 106B. In some implementations, the work implement may be uncoupled from the lifter arms by removing a coupling pin (e.g., a clevis pin).

In many implementations, such as those involving wheel loaders as illustrated and described herein, the work implement may be uncoupled from two separate lifter arms. In other implementations, however (e.g., a backhoe, post-hole digger), only a single lifter arm may be employed to retain and actuate the work implement.

The method 500 further includes securing (507) a first extension to a first lifter arm and a second extension to a second lifter arm. For example, with reference to FIG. 3A, the extension 340 may be secured to the lifter arm 307. The extension 340 can include an assembly of an extension plate, an inner cap plate, an outer cap plate, and optional spacers—such as those elements illustrated in FIG. 2E. In some implementations, separate extensions are secured to separate lifter arms (e.g., the lifter arms 106A and 106B of FIG. 1B).

The method 500 further includes coupling (510) the implement to the first extension and the second extension. For example, with reference to FIG. 3A, the bucket 305 may be coupled to the extension assembly 340.

The method 500 further includes coupling (513) a second linkage to the work implement and the actuated rocker arm. For example, with reference to FIG. 3A, the bucket 305 may be coupled to actuated rocker arm 318 with a second linkage 311 that is longer than the original linkage 310.

In some implementations, an exemplary method 500 may include additional steps. For example, an alignment rod (e.g., an alignment rod 470, illustrated in FIG. 4) may be employed to align the first and second extensions relative to each other, prior to the first and second extensions being secured to the corresponding lifter arms. Other steps may be included.

The elements and methods described herein may provide several advantages. For example, replacement of a material mover may be obviated, and its utility may be extended. The utility may be extended without requiring any permanent modifications (e.g., welding or cutting). A single operator working alone or with readily available tools (e.g., a hand truck and portable winch or lift) may be able to modify the material mover. That is, each individual component described herein may be small enough and light enough in weight to facilitate handling by a single operator.

In some implementations, modifications (e.g., to convert a material mover from configuration 304A to configuration 304B, as shown in FIGS. 3A and 3B) may be performed quickly—for example, within 30 minutes or less, 60 minutes or less, 15 minutes or less, etc. In some implementations, a kit, such as that described herein, may be easily shipped, with minimal shipping costs.

Various implementations have been described, and the reader will appreciate that other variations are possible without departing from the principles described herein. For example, an extension can be applied to a material mover with one or two lifter arms. Extension plates and linkages can be dimensioned differently than illustrated to provide greater extensions of operating reach or height. Various removable fasteners may be employed. It is therefore intended that the scope not be limited to specific implementations disclosed herein but rather include all aspects falling within the scope of the appended claims.

What is claimed is:

1. An extender for a material mover, the extender comprising:

an extension plate comprising (a) an arcuate recess configured to be disposed around a top edge, a front edge and a bottom edge of a lifter arm on the material mover, and (b) an extended-lifter segment with an implement-retention aperture disposed at its end, opposite the arcuate recess; wherein the extension plate includes a first aperture and second aperture that, when the extension plate is disposed around the lifter arm, are adjacent the top edge and bottom edge respectively;

an inner cap plate and outer cap plate that each includes a top aperture, a bottom aperture and a retention aperture; wherein, when the inner cap plate and outer cap plate are disposed on either side of the lifter arm and extension plate, the top apertures are aligned with the first aperture, the bottom apertures are aligned with the second aperture, and the retention aperture is aligned with a lifter-arm retention aperture;

securing fasteners configured to secure the inner cap plate, outer cap plate and extension plate together (i) through the top apertures and first aperture and (ii) through the bottom apertures and second aperture;

a securing pin configured to secure the inner cap plate, outer cap plate and lifter arm together through the retention apertures and the lifter-arm retention aperture.

2. The extender of claim 1, further comprising one or more spacers, each of the one or more spacers comprising a top-spacer aperture, a bottom-spacer aperture, and an arcuate-spacer recess.

3. The extender of claim 2, wherein, when the one or more spacers are disposed adjacent the lifter arm and extension plate and between the outer cap plate and inner plate, the top-spacer aperture is aligned with the top apertures and first aperture, and the bottom-spacer aperture is aligned with the bottom-spacer apertures and second aperture.

4. The extender of claim 2, wherein the arcuate-spacer recess is configured to fit snugly around the lifter arm of a specific make and model of a material mover.

5. The extender of claim 1, wherein the securing pin comprises a large-bore threaded bolt and nut.

6. The extender of claim 1, wherein the securing pin comprises a clevis pin.

7. The extender of claim 1, wherein the securing fasteners comprise threaded bolts and nuts.

8. The extender of claim 1, wherein the material mover is a front-end loader.

9. A kit for extending a vertical reach of a material mover, the kit comprising:

first and second extenders for corresponding first and second lifter arms of the material mover; each of the first and second extenders comprising (A) an extension plate comprising (i) an arcuate recess configured to be disposed around a top edge, a front edge and a bottom edge of a corresponding first or second lifter arm and (ii) an extended-lifter segment with an implement-retention aperture disposed at its end, opposite the arcuate recess; wherein the extension plate includes a first aperture and second aperture that, when the extension plate is disposed around the corresponding lifter arm, are adjacent the top edge and bottom edge respectively; and (B) an inner cap plate and outer cap plate that each includes a top aperture, a bottom aperture and a retention aperture; wherein, when the inner cap plate and outer cap plate are disposed on either side of the corresponding lifter arm and extension plate, the top apertures are aligned with the first aperture, the bottom apertures are aligned with the second aperture, and the retention aperture is aligned with a lifter-arm retention aperture;

securing pins configured to secure corresponding lifter arms, inner cap plates, and outer cap plates through the retention apertures and lifter-arm retention apertures; and an extended linkage configured to couple, on one end, an implement that is removably attached to the first and second extenders through the implement-retention apertures, and on the other end, an actuated rocker arm of the material mover.

10. The kit of claim 9, further comprising an alignment rod configured to be temporarily disposed in the implement-retention apertures of the first and second extenders, as the first and second extenders are secured to the corresponding first or second lifter arms.

11. A method of extending a reach of a material mover, the method comprising:

uncoupling and removing a first linkage that couples a work implement to an actuated rocker arm on the material mover;

uncoupling the work implement from a first lifter arm and from a second lifter arm;

securing a first extension to the first lifter arm and a second extension to the second lifter arm, wherein securing each of the first extension and second extension comprises (a) fastening, with a first fastener, a first or second extension to a corresponding first or second lifter arm, though a lifter-arm retention aperture, and (b) further securing the relevant first or second extension to the corresponding first or second lifter arm with a second fastener adjacent a top edge of an end of the corresponding lifter arm and a third faster adjacent a bottom edge of the end of the corresponding lifter arm;

coupling the work implement to the first extension and second extension; and coupling a second linkage to the work implement and the actuated rocker arm, wherein the second linkage is longer than the first linkage.

12. The method of claim 11, wherein the work implement comprises a bucket.

13. The method of claim 11, wherein the work implement comprises lifting forks.

14. The method of claim 11, wherein uncoupling the work implement comprises removing a first coupling pin that couples one side of the implement to the first lifter arm and removing a second coupling pin that couples another side of the work implement to the second lifter arm.

15. The method of claim 11, wherein the first extension and second extension each comprises an outer cap plate, an inner cap plate, and an extension plate; wherein the outer cap plate and inner cap plate each comprise a retention aperture configured to align with a corresponding lifter-arm retention aperture.

16. The method of claim 11, wherein the first extension and second extension each further comprise one or more spacer plates that are configured to fit snugly around an end of the corresponding lifter arm for a specific make and model of material mover.

17. The method of claim 11, wherein the first extension and second extension each have an arcuate recess configured to fit around an end of a corresponding lifter arm.

18. The method of claim 17, wherein the extension plate has a first aperture and second aperture, and wherein each of the outer cap plate and inner cap plate have top apertures and bottom apertures; wherein the first aperture is configured to be aligned with the top apertures, and the second aperture is configured to be aligned with the bottom apertures.

19. The method of claim 18, wherein further securing the relevant first or second extension comprises securing the outer cap plate, inner cap plate and extension plate with a first securing fastener disposed through the first aperture and top apertures and with a second securing fastener disposed through the second aperture and bottom apertures.

20. The method of claim 11, further comprising aligning the first extension and second extension by disposing an alignment rod in an extension-aperture of the first extension and an extension-aperture of the second extension prior to securing the relevant first or second extension to the corresponding first or second lifter arm.

* * * * *